US009895566B2

(12) United States Patent
Zbinden

(10) Patent No.: US 9,895,566 B2
(45) Date of Patent: Feb. 20, 2018

(54) HOOKLESS ANKLE-BASED INVERSION DEVICE

(71) Applicant: Adam Zbinden, Tualatin, OR (US)

(72) Inventor: Adam Zbinden, Tualatin, OR (US)

( * ) Notice: Subject to any disclaimer, the term of this patent is extended or adjusted under 35 U.S.C. 154(b) by 184 days.

(21) Appl. No.: 14/990,719

(22) Filed: Jan. 7, 2016

(65) Prior Publication Data

US 2016/0361582 A1 Dec. 15, 2016

Related U.S. Application Data

(60) Provisional application No. 62/175,248, filed on Jun. 13, 2015.

(51) Int. Cl.

| | |
|---|---|
| ***A63B 21/00*** | (2006.01) |
| ***A63B 69/00*** | (2006.01) |
| ***A63B 21/068*** | (2006.01) |
| ***A63B 23/035*** | (2006.01) |
| ***A63B 23/12*** | (2006.01) |
| *A63B 1/00* | (2006.01) |
| *A63B 21/04* | (2006.01) |
| *A63B 21/055* | (2006.01) |
| *A63B 23/02* | (2006.01) |
| *A63B 23/04* | (2006.01) |
| *A63B 23/00* | (2006.01) |

(52) U.S. Cl.

CPC ..... *A63B 21/00043* (2013.01); *A63B 21/068* (2013.01); *A63B 21/4025* (2015.10); *A63B 23/03541* (2013.01); *A63B 23/1218* (2013.01); *A63B 69/0059* (2013.01); *A63B 1/00* (2013.01); *A63B 21/0442* (2013.01); *A63B 21/0552* (2013.01); *A63B 21/4013* (2015.10); *A63B 21/4015* (2015.10); *A63B 21/4019* (2015.10); *A63B 21/4021* (2015.10); *A63B 21/4034* (2015.10); *A63B 21/4035* (2015.10); *A63B 21/4043* (2015.10); *A63B 23/0238* (2013.01); *A63B 23/0405* (2013.01); *A63B 2023/006* (2013.01); *A63B 2208/029* (2013.01); *A63B 2208/0285* (2013.01)

(58) Field of Classification Search

CPC ..... A61H 1/0229; A61H 2203/0493; A63B 2208/025; A63B 21/4013; A63B 21/4015; A63B 21/0442

USPC ..... 482/143, 144

See application file for complete search history.

(56) References Cited

U.S. PATENT DOCUMENTS

| | | | | |
|---|---|---|---|---|
| 7,722,508 | B2 * | 5/2010 | Hetrick | A63B 21/00043 482/139 |
| 8,007,413 | B1 * | 8/2011 | Wu | A63B 21/068 482/131 |
| 8,038,584 | B1 * | 10/2011 | Pruessner | A61H 1/02 482/143 |
| 8,043,197 | B2 * | 10/2011 | Hetrick | A63B 21/0023 482/904 |

(Continued)

*Primary Examiner* — Joshua T Kennedy

(57) ABSTRACT

A device for performing ankle-based inversion therapy, based on the method established by gravity boots. The device includes a mounting component at its top which enables attachment to support bars, while the primary loop of the device is adjustable in size and conforms to the ankle. A handle and extension are used to enter the inverted posture and to open the primary loop upon exit. Grip loops on the outside of the primary loop are used to manipulate the device with opposite toes during use.

1 Claim, 4 Drawing Sheets

| DEVICE COMPONENTS | |
|---|---|
| 1 | MOUNTING LOOP |
| 2 | PRIMARY LOOP |
| 3 | HANDLE EXTENSION |
| 4 | HANDLE |
| 5 | TOE-GRIP LOOPS |

(56) References Cited

U.S. PATENT DOCUMENTS

| | | | | |
|---|---|---|---|---|
| 8,192,337 | B2 * | 6/2012 | Birch | A63B 21/00185 482/126 |
| 9,597,541 | B2 * | 3/2017 | Hinds | A63B 7/00 |
| 2005/0227833 | A1 * | 10/2005 | Wilkinson | A63B 21/0004 482/124 |
| 2007/0173383 | A1 * | 7/2007 | Feigenbaum | A63B 21/1663 482/91 |
| 2012/0277074 | A1 * | 11/2012 | Zeldakov | A63B 21/154 482/126 |
| 2012/0329620 | A1 * | 12/2012 | White | A63B 21/151 482/131 |
| 2014/0073496 | A1 * | 3/2014 | Bannerman | A63B 21/0442 482/139 |
| 2014/0155233 | A1 * | 6/2014 | Latronica | D04G 5/00 482/124 |
| 2016/0023051 | A1 * | 1/2016 | Lauener | A61H 1/0229 482/143 |

* cited by examiner

| DEVICE COMPONENTS | |
|---|---|
| 1 | MOUNTING LOOP |
| 2 | PRIMARY LOOP |
| 3 | HANDLE EXTENSION |
| 4 | HANDLE |
| 5 | TOE-GRIP LOOPS |

HOOKLESS ANKLE-BASED INVERSION DEVICE

BACKGROUND OF THE INVENTION

Inversion therapy is a method for achieving a decompression of the musculoskeletal system. Spinal traction occurs when the head is at a lower plane of elevation than the feet, thereby reversing the normal gravitational loading which occurs while standing or sitting.

The degree of traction is measured by the angular displacement of the head from the horizontal plane which exists while lying flat in a prone position. The range of traction is therefore zero to ninety degrees, with maximum traction occurring while suspended orthogonal to the level surface below.

Gravity boots are an established method for enabling an inverted posture through ankle-based suspension. Traditional gravity boot designs use hooks which connect to an elevated horizontal bar. This requires attaching a pair of gravity boots to the ankles, and then raising the feet to the elevation of the bar to enter the inverted posture.

SUMMARY OF THE INVENTION

The purpose of the device is to provide a means for suspension by the ankles in a fully inverted position and thereby achieve maximum traction. Pull-up bars, of the type used in gymnastics and fitness activities which are designed to support the static loads generated by human body weight, are the intended support structures for this device to be used in conjunction with.

The device described can be constructed from synthetic polymer webbing which has a rated tensile strength which determines the safe working load. It is sewn together, according to the described design, using synthetic polymer thread which is also rated in terms of the load-bearing capacity of each stitch (pounds/stitch). This combination of materials provides a means to predict the maximum load bearing capacity of this device when assembled, and thereby incorporate large safety factors.

Advantages to using the device for ankle-based inversion therapy are:

1. The device adds no weight to the ankles. When the feet are raised up toward the mounting bar, no extra load must be carried, which translates to less effort required.
2. The device described, when mounted to a horizontal support bar, has handles which are significantly lower in elevation than the bar itself. This makes it unnecessary to reach all the way to the bar when exiting the inverted position, because the device has extended handles which are closer to the hands.
3. The load tension of applied body-weight causes the device to close around the ankles, due to its self-tightening nature. It is therefore not possible to fall or slip out of the device while in the inverted position.

While the device described enables decompression of the spine and joints, said device can also be used as a fitness tool. Exercises which can be performed while in the inverted posture include:

1) Sit-ups
2) Reverse crunches and back extensions
3) Reverse squats, an exercise functionally equivalent to a full glute-ham raise

DETAILED DESCRIPTION OF THE INVENTION

Figure 2:
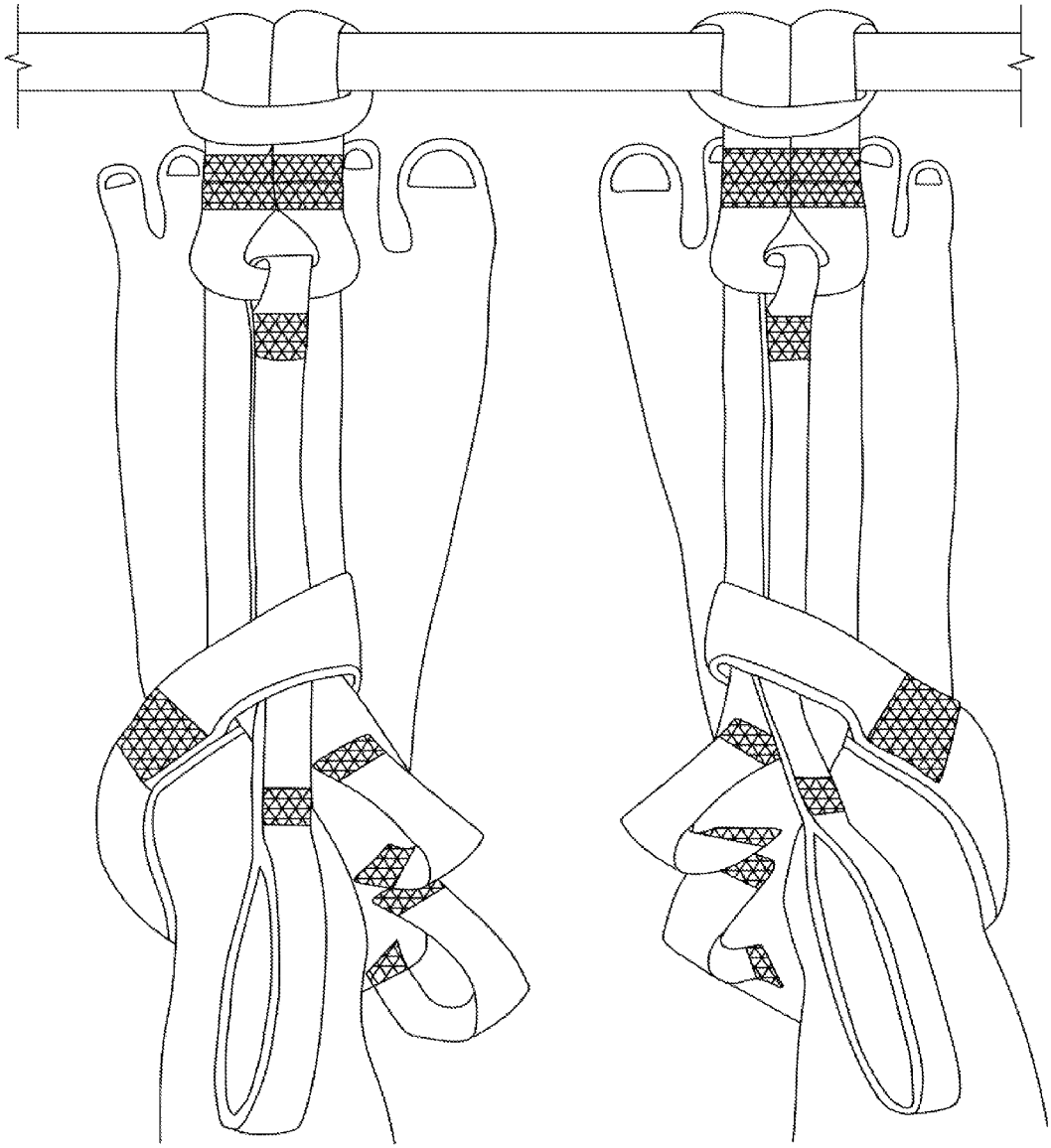
FIG. 2 depicts two devices attached to a horizontal mounting bar and secured around both ankles.
Figure 3:
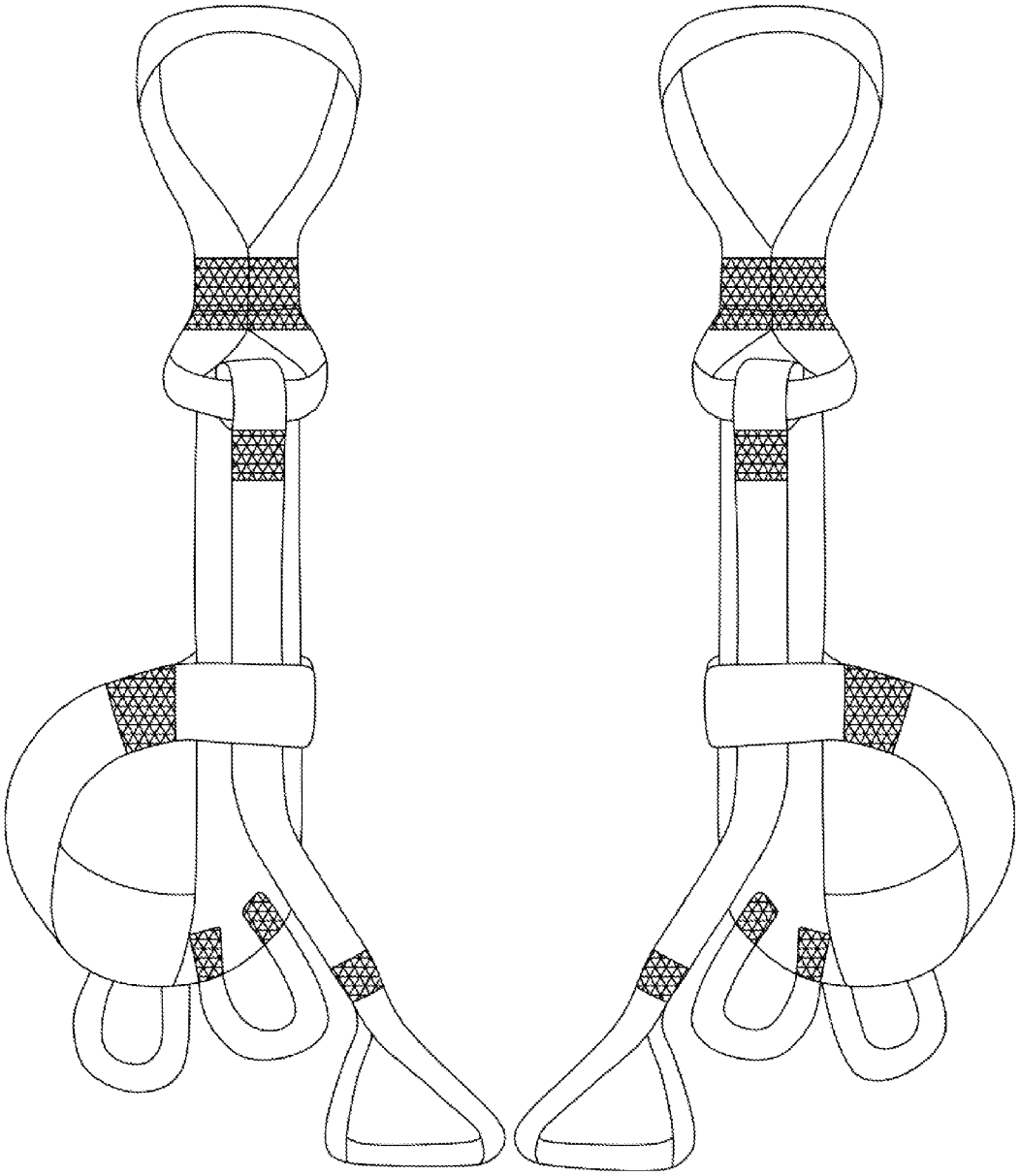
FIG. 3 depicts a pair of devices and the directional difference between the left and right version.
Figure 4:
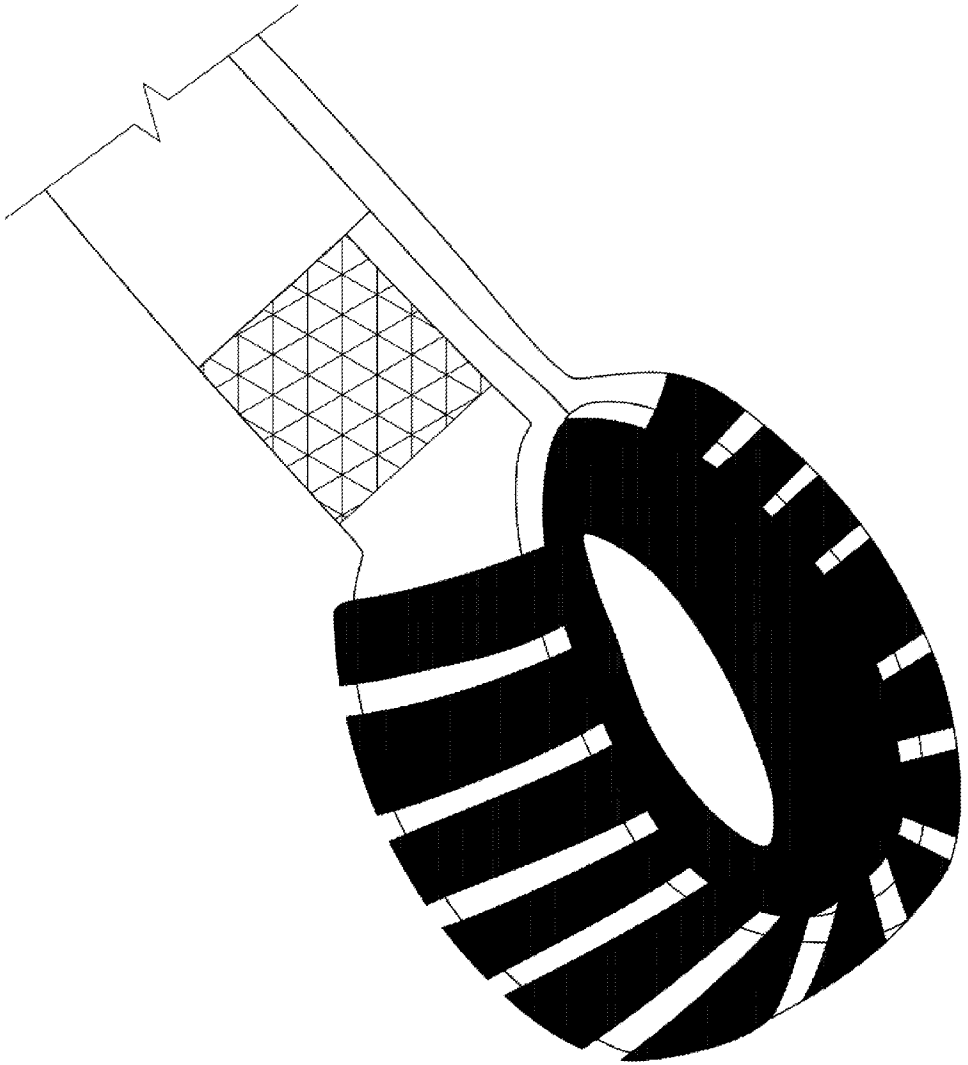
FIG. 4 depicts the moveable end of the primary loop with an attached shield to prevent abrasion.

The Primary Loop of the Device Will not Open or Expand after being Tensioned Around the Ankle if the Handle Extension is Outside of the Moveable End of the Primary Loop Directions for Entering the Inverted Posture:

1. Verify left and right device orientation. The left should form a lowercase "D" letter shape, and the right should form a lowercase "B" letter shape, as shown in FIG. 3.
2. Attach a pair of devices to the horizontal support bar, by placing the mounting loop over the bar and then threading the body of the device through the loop as shown in FIG. 2.
3. Expand the primary loop into the fully open position. This provides maximum surface area for foot insertion.
4. Grasp the handle of the left-foot device with the left hand, and grasp the right-foot device handle with the right hand, and verify that all connections are secure by lifting feet off the ground and applying body-weight load to the pair of devices.
6. Raise feet upward to the bar while holding device handles, and lean back simultaneously to minimize the amount of upper-body effort required.
7. Position the device around each ankle by inserting the left and right foot through the opening provided by the primary loop of each device.
8. While still holding the handles, tighten each device around the ankles by pulling both feet downward.
9. Release the handles and move backward into a fully inverted posture.

Directions for Exiting the Inverted Posture:

1. Raise the torso upward until the handles are within reach.
2. Grasp the left handle with the left hand, and the right handle with the right hand. Apply load to each handle by pulling downward as if the weight of the upper body were being supported by the handles and their extensions.
3. Shifting the static load application point, as described in the previous step, allows the main loop of the device to be relaxed and expanded. While supporting the majority of body weight with the handles, use the toes of an opposite foot to manipulate the toe-hold loop and pull the primary loop from the ankle.
4. Using a controlled movement, while holding the handles securely, lower the feet to the ground. Do not release the handles until footing is secure.

Load tension can be applied to the device by a user at either the primary loop, when closed around the ankle and suspended, or at the handle, when using the hands and arms to engage the device.

Applied user load tension can only be transferred to a support structure at the top-most point of the device, by either the mounting loop or the connected handle-extension. This is a requirement for device operation.

Figure 1:
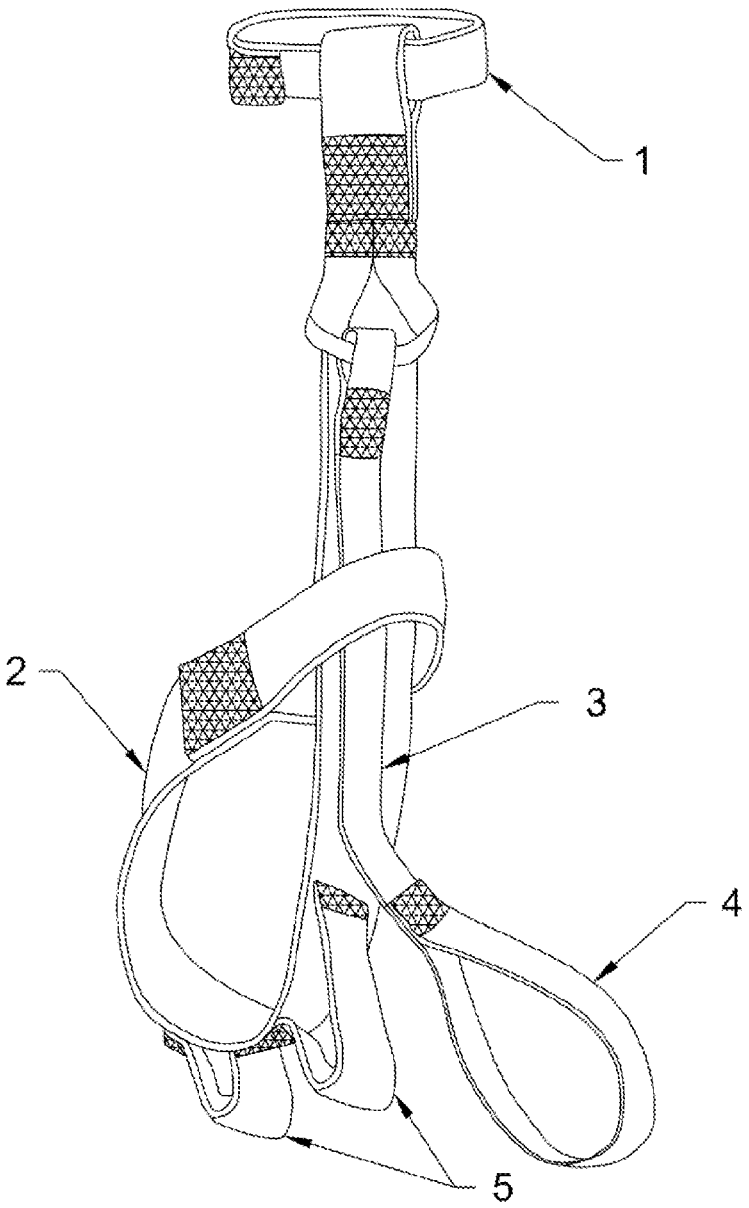
FIG. 1 depicts the device of claim 1, where the mounting loop (1) connects the device to a bar support structure, the primary loop (2) retains the ankle, the handle-extension (3) provides leverage for expanding and opening (2) when load is applied to the handle (4), and the toe-hold loops (5) allow movement and control of (2) with an opposite foot.

Instructions for Assembling the Device:

The bowed region of (2), as shown in FIG. 1, is directed outward when facing the user and the straight region of (2) is on the inside, to optimally distribute the load tension around the ankle and avoid pressure point formation.

The size of the device can be scaled according to foot-size and ankle circumference. The relative dimensions of the components shown in FIG. 1 are critical.

The handle (4) must be large enough to accommodate the hand, the primary loop (2) must be sized to accommodate the through-passage of the foot, and the handle extension (3) must be of sufficient length to remain inside of the moveable end of the primary loop (2) when (2) is fully contracted around the ankles. The size of the mounting loop (1) must enable encirclement of the supporting bar structure and allow the whole device to pass through during the device-mounting process.

An ideal construction material is polyester webbing, with 2" width used for the main loop and body of the device, and 1" width used for all other components. The width-reducing attachment interface between the main loop and the handle extension maximizes the surface area of the seams connecting these two components.

Webbing used for assembly is heat sealed at exposed ends to prevent fraying. Heat-treated ends are hard and brittle and can be folded to prevent contact abrasion.

Sheaths to prevent webbing abrasion can be installed on sections of the device which are exposed to friction. These sections can include the moveable end of the primary loop (2), the mounting loop (1), and the handle (4).

The invention claimed is:

1. A device which enables suspension from a user's ankles in a fully inverted physical posture, comprising:

a) a primary webbing loop comprising
  a strap portion,
  a mounting loop attachment point at a first end of the strap portion; and
  a self-encircling loop extending from a second end of the strap portion,
  wherein the strap portion is threaded through the self-encircling loop such that the self-encircling loop is moveable along the strap portion to create an ankle-surrounding region which can change circumference based on applied tension;

b) a mounting loop connected to the strap portion at the mounting loop attachment point;

c) a handle extending from a handle strap which is connected to the primary webbing loop strap portion adjacent the mounting loop attachment point, wherein the handle strap extends through the self-encircling loop and is of sufficient length to remain therein throughout a total range of motion of the primary webbing loop; and d) at least one toe loop connected to the ankle-surrounding region of the primary webbing loop strap portion and proximate the self-encircling loop which provides a toe-hold for controlling the device with an opposite foot.

* * * * *